US006151838A

United States Patent [19]

Husein

[11] Patent Number: 6,151,838

[45] Date of Patent: Nov. 28, 2000

[54] ROOF CURB AND METHOD OF INSTALLATION

[75] Inventor: King Husein, Madera, Calif.

[73] Assignee: Golden Eagle Building Products Inc., Madera, Calif.

[21] Appl. No.: 09/199,038

[22] Filed: Nov. 24, 1998

[51] Int. Cl.[7] ..... E04D 1/36

[52] U.S. Cl. ..... 52/58; 52/200

[58] Field of Search ..... 52/58, 60, 199, 52/200, 219, 656.1, 748.1

[56] References Cited

U.S. PATENT DOCUMENTS

| | | | |
|---|---|---|---|
| D. 217,223 | 4/1970 | Knohl . | |
| D. 221,941 | 9/1971 | Murphy . | |
| D. 387,442 | 12/1997 | Toovey . | |
| D. 391,648 | 3/1998 | Solbeck . | |
| 4,413,450 | 11/1983 | Brower . | |
| 4,559,753 | 12/1985 | Brueske . | |
| 4,887,399 | 12/1989 | Berger . | |
| 4,917,345 | 4/1990 | Czech . | |
| 5,016,406 | 5/1991 | Calam . | |
| 5,027,576 | 7/1991 | Gustavsson | 52/748 |
| 5,148,647 | 9/1992 | Rutledge . | |
| 5,409,266 | 4/1995 | Baker | 52/199 |
| 5,465,533 | 11/1995 | Rummo . | |
| 5,673,520 | 10/1997 | Yannucci | 52/58 |
| 5,687,514 | 11/1997 | Gillispie | 52/58 |
| 5,806,255 | 9/1998 | Verby | 52/200 |
| 5,832,674 | 11/1998 | Ledbetter | 52/58 |
| 5,896,711 | 4/1999 | McClure | 52/200 |

*Primary Examiner*—Beth A. Stephan
*Attorney, Agent, or Firm*—Mark D. Miller

[57] ABSTRACT

Disclosed is a simple, easy and efficient metal roof curb system and method for attachment which includes a generally rectangular curb assembly, the edges of which have inwardly facing upper and lower flanges to facilitate secure and waterproof attachment to the roof panels. One end of the curb assembly is designed for attachment at the low or downwardly facing side of the roof, and the opposite end is designed to be attached to the high or upwardly facing side of the roof. The low end of the assembly includes a set of recesses designed for alignment with and attachment to the ribs of the metal roof. The high end includes no such recesses, but is instead designed for direct attachment to the flattened roof panels, the ribs of which are cut and plugged. A pre-attached Z-shaped water diverter is included on the high side, the assembly calling for a water diverting cricket to be installed on the high side in the field. Bull nose covers lined with waterproof material are installed to cover plugs on the high side ribs where they have been cut.

11 Claims, 5 Drawing Sheets

ROOF CURB AND METHOD OF INSTALLATION

BACKGROUND OF THE INVENTION

1. Field of the Invention

The present invention relates to metal roofing on buildings, and more particularly to a new roof curb system and method of installation.

2. Description of the Prior Art

Metal buildings having metal roofing have become popular for commercial, industrial and warehousing uses. Such buildings often require roof openings for such equipment as skylights, fans, air conditioning units, and the like. The installation of such equipment requires a roof curb unit for support.

Roof curb systems are well known in the art. U.S. Pat. No. 4,559,753 describes a method of installation of a metal roof curb unit in which the rims of the curbs are pre-welded to a roof panel, and the curb containing-panel is attached to a large opening cut into the roof. However, this method requires cutting a hole in the roof that is much larger than the opening for the equipment, and it is highly susceptible to leakage.

Other patents describe single or multi-sided roof curbs such as U.S. Pat. Nos. 4,917,345, 5,016,406, 5,148,647 and 5,465,533 which describe adjustable and/or interlocking roof curbs.

The following U.S. Patents are also known to exist:

| U.S. Pat. No. | Issue Date | Inventor |
|---|---|---|
| 4,413,450 | November 8, 1983 | Brower |
| 4,887,399 | December 19, 1989 | Berger |
| DES 217,223 | April 21, 1970 | Knohl |
| DES 221,941 | September 21, 1971 | Murphy |
| DES 387,442 | December 9, 1997 | Toovey |
| DES 391,648 | March 3, 1998 | Solbeck |

SUMMARY OF THE INVENTION

The present invention provides a simple, easy and efficient metal roof curb system and method for attachment. The roof curb system of the present invention includes a generally rectangular curb assembly the edges of which have inwardly facing upper and lower flanges to facilitate secure and waterproof attachment to the roof panels. One end of the curb assembly is designed for attachment at the low or downwardly facing side of the roof, and the opposite end is designed to be attached to the high or upwardly facing side of the roof. The low end of the assembly includes a plurality of recesses designed for alignment with and attachment to the ribs of the metal roof. The high end includes no such recesses, and is instead designed for direct attachment to the flattened roof panels. A pre-attached Z-shaped water diverter is included on the high side, the assembly calling for a water diverting cricket to be installed on the high side in the field.

The method of attachment to the roof includes first cutting an opening to receive the curb unit, and then cutting away a portion of the roof support ribs on the high side. A sub assembly is installed below the opening to provide support around the perimeter of the opening. The roof curb assembly is then attached over the opening using fasteners to attach the inwardly facing flanges through the metal roof to the supporting sub assembly. Suitable waterproofing material such as double-sided adhesive tape (Mastic) is provided between the flanges and the roof, and at all locations where metal parts are attached. Caulking should also be used at all waterproof locations, especially at joints between pieces of double sided tape. At the low end, the plurality of recesses on the curb assembly are aligned with and attached over the ribs of the metal roof, with waterproofing material in between.

The cut-away portions of the roof ribs at the high end are disengaged and flattened between the locations of the cuts and the roof curb. The open ends of the roof ribs are closed using waterproof material and specially formed closure plugs. A cricket is then attached to the roof curb assembly on the high side such that it extends out over the adjacent flattened areas on the roof. Bull nose covers lined with waterproof material are then installed to cover the plugs and flattened areas adjacent to the cricket to prevent leakage.

The roof curb assembly is then ready to be insulated, and to have equipment such as a skylight, fan, air conditioning unit, or the like installed thereon.

It is therefore a primary object of the present invention to provide simple, effective and aesthetically appealing waterproof roof curb system for metal buildings.

It is also an important object of the present invention to provide a simple and easy method for installing a simple, effective and aesthetically appealing waterproof roof curb system for metal buildings.

Other objects of the invention will be apparent from the detailed descriptions and the claims herein.

DETAILED DESCRIPTION OF THE PREFERRED EMBODIMENT

Figure 1:
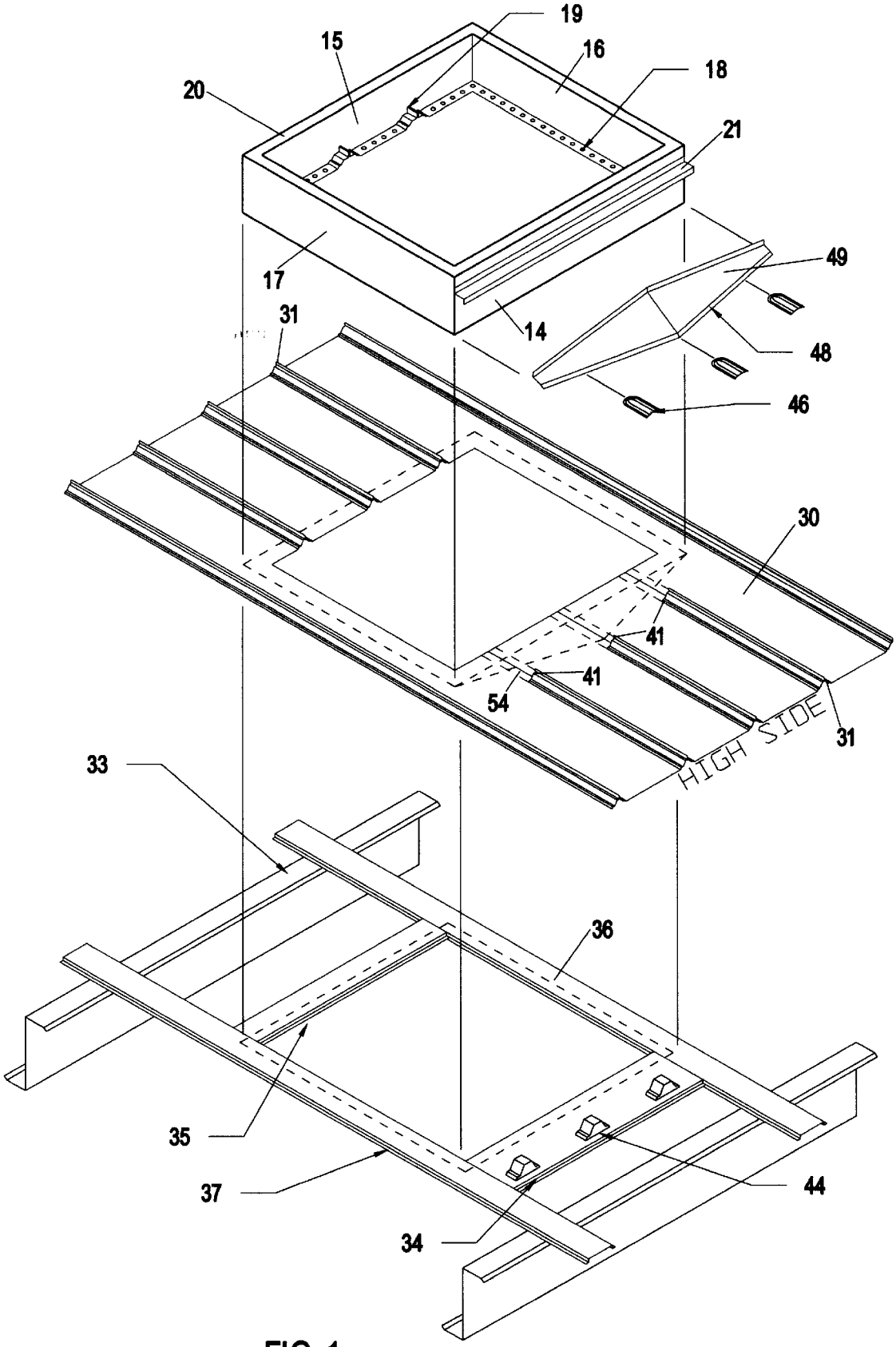
FIG. 1 is a perspective and partially exploded view showing the general installation of the present invention.

Referring to the drawings wherein like reference characters designate like or corresponding parts throughout the several views, and referring particularly to FIGS. 1–3, 8 & 10 it is seen that the invention includes a generally rectangular frame assembly 10 having a high side panel 14, a parallel low side panel 15, and two connecting side panels 16 and 17. A Z-shaped water diverting flange 21 is pre-attached to high side panel 14 by welding or other suitable means. Each of panels 14–17 is provided with inwardly facing lower flanges 18 for attachment to the roof panels 30 (see detail in FIG. 10) and inwardly facing upper flanges 20 for supporting equipment such as a skylight, fan, air conditioning unit, or the like. Low side end panel 15 includes a plurality of recesses 19 designed for alignment with and attachment to the ribs 31 of the metal roof 30.

A generally rectangular supporting sub-assembly 32 is provided for installation below the roof panels 30. Parallel high and low end supports 34 and 35, respectively, are provided in perpendicular alignment to side supports 36 and 37. Side supports 36 and 37 are extended in order to rest on top of roof purlins or bar joists 33, and to fit between them and roof panels 30. High end support 34 is wider than support 35 in order to provide an area for attachment of the flattened roof ribs, the plugs, the cricket and the bull noses, as discussed below.

Figure 2:
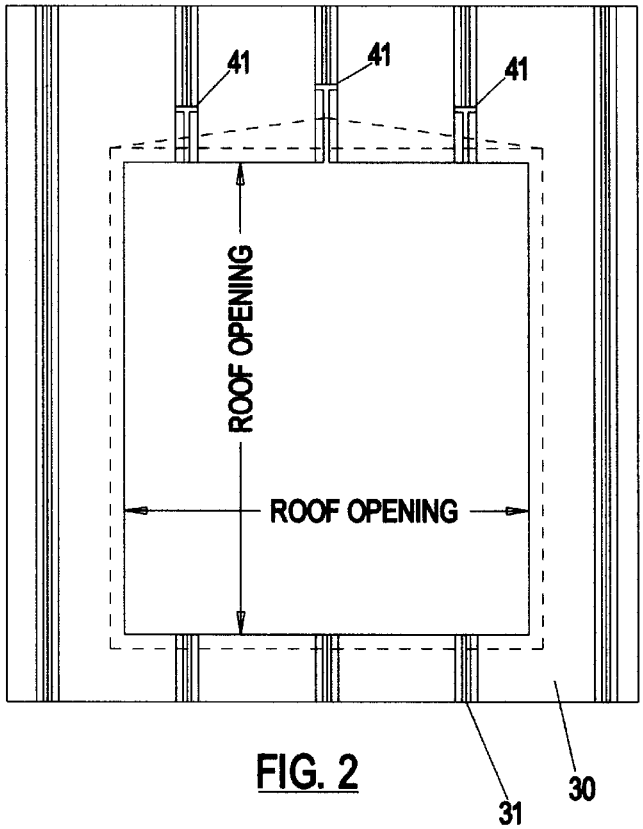
FIG. 2 is a top plan view of the roof opening for receiving the curb assembly of the present invention (shown in phantom lines).
Figure 3:
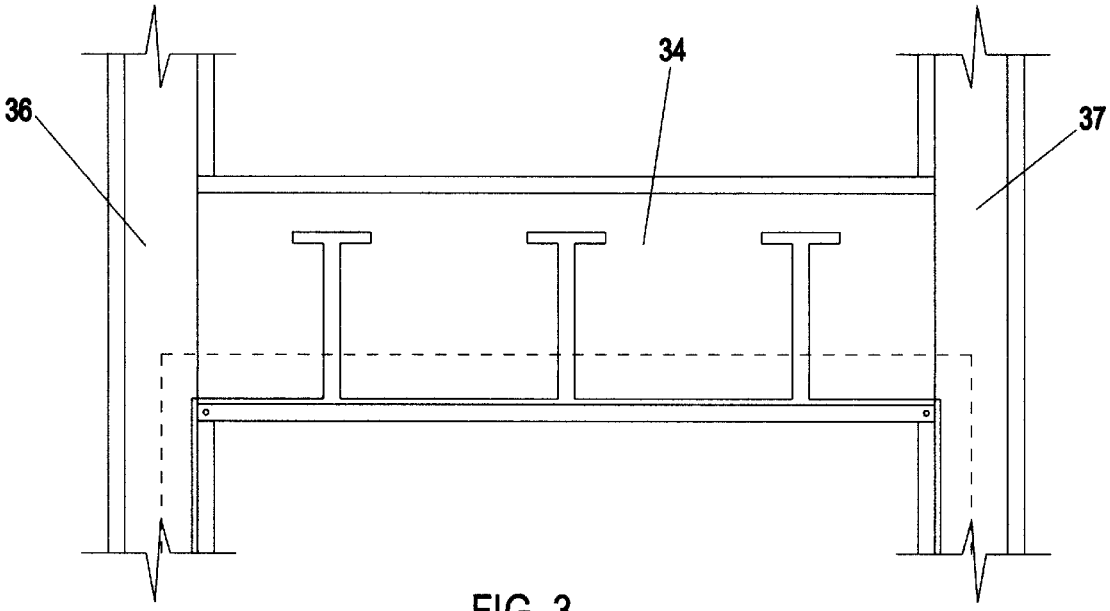
FIG. 3 is a side elevational view of the support sub assembly of the present invention.

The installation of the roof curb assembly 10 is accomplished by the cutting of an appropriately sized opening in the roof. This opening cuts through roof panels 30 and ribs 31 as shown in FIG. 2, and is sized to correspond with the inside area of assembly 10 bounded by flanges 18. Sub-assembly 32 is also sized to correspond with the opening and assembly 10, and is inserted between the roof 30 and purlins 33 as shown in FIG. 1. Support 34 corresponds to panel 14, support 35 corresponds to panel 15, etc.

Figure 4:
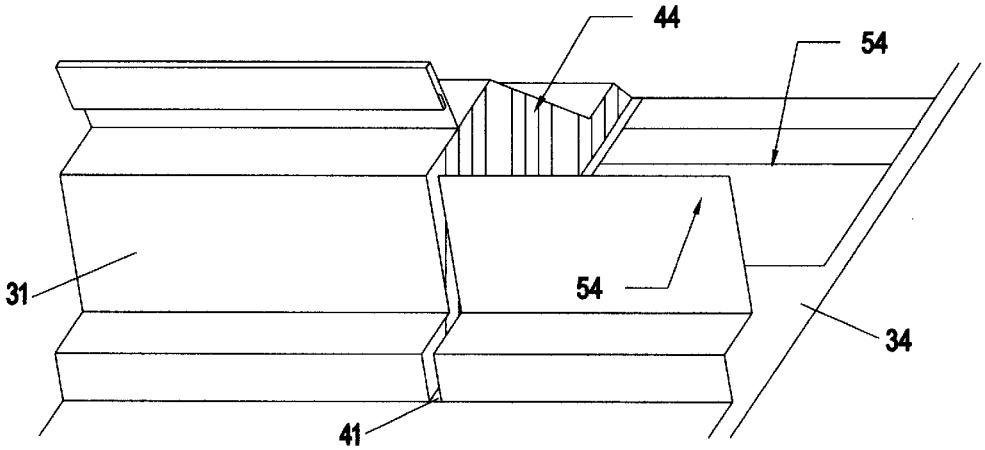
FIG. 4 is a perspective view of the roof in the vicinity of the flattened roof panels.
Figure 5:
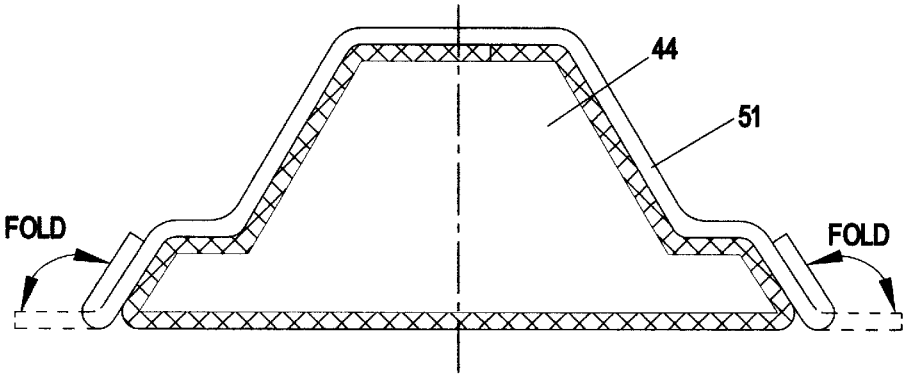
FIG. 5 is a cut away side view of a molded roof rib plug prior to installation.
Figure 6:
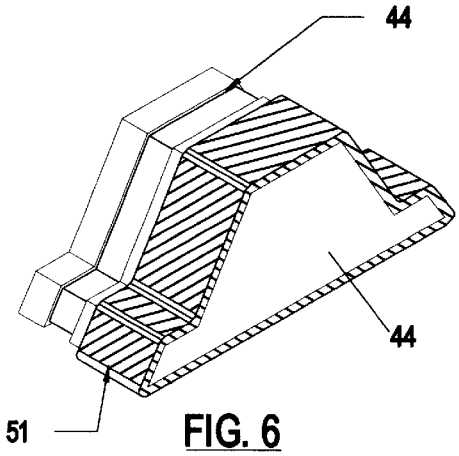
FIG. 6 is a perspective view of a molded roof rib plug prior to installation.
Figure 7:
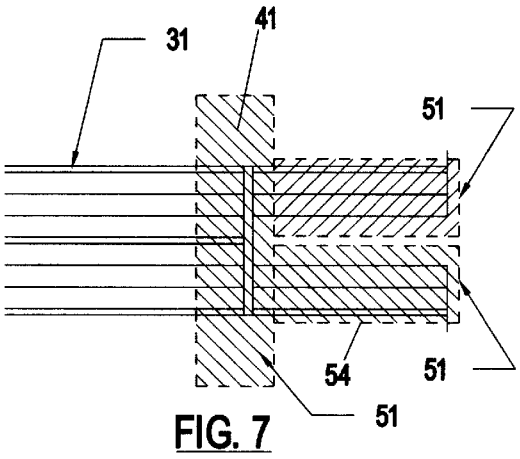
FIG. 7 is a top plan view of the flattened areas of the roof showing adhesion thereof in phantom lines.

Prior to attachment of the curb assembly 10, the roof ribs 31 on the high side are cut at locations 41. The cut rib flanges 54 are then folded flat as shown in FIG. 4. Waterproof double sided tape or the like 51 is placed on support 34 below flanges 54 as shown in FIG. 7, and the flanges are adhered thereto. Molded or formed plug assemblies 44 are then wrapped with double sided tape 51 as shown in FIGS. 5 & 6, and inserted into the open ends of ribs 31 as shown in FIG. 4.

Figure 10:
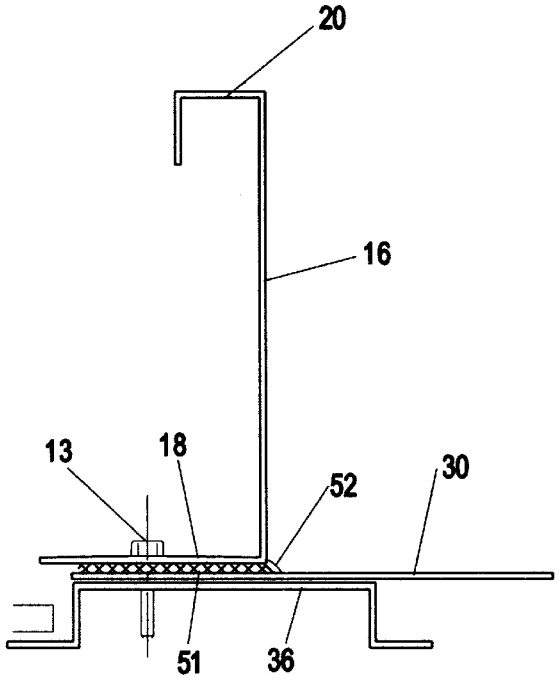
FIG. 10 is a cut away side view showing installation of the roof curb and sub assembly.
Figure 11:
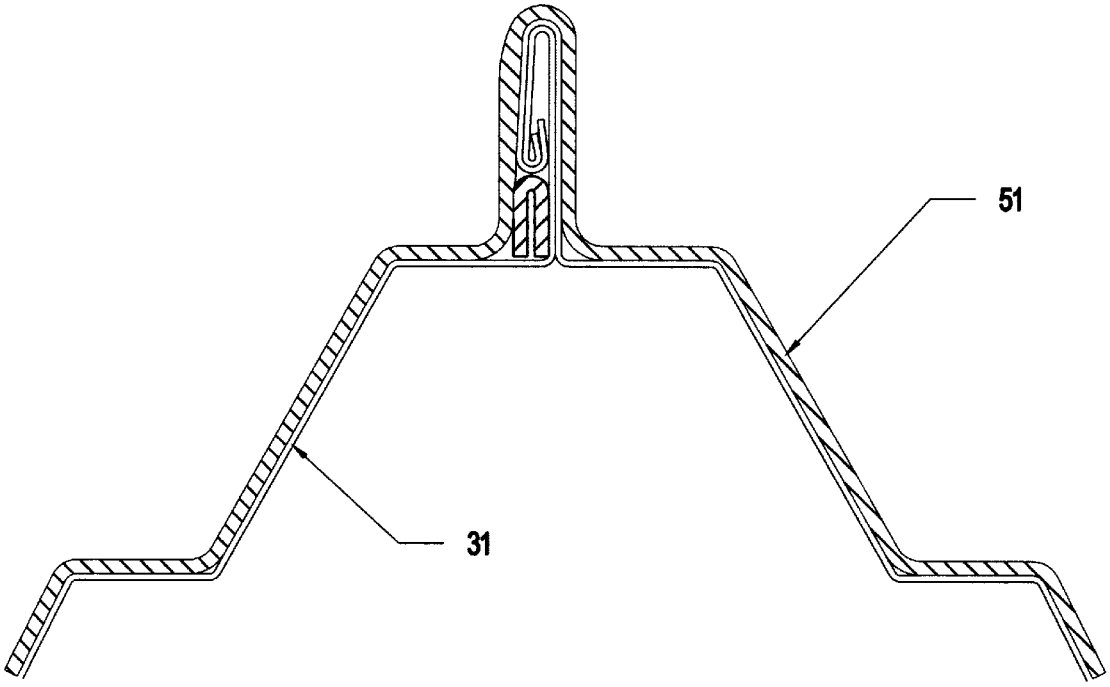
FIG. 11 is a cut away side view of a roof rib with adhesive material applied prior to installation of the curb assembly over it.

The curb assembly 10 is then attached over the opening such that inwardly facing flanges 18 are at the perimeter thereof. Double sided adhesive material 51 is placed between flanges 18 and roof panels 30 as shown in FIG. 10. Fasteners 13 are used to attach flanges 18 through roof panels 30 to support sub-assembly 32. A bead of caulk 52 is also provided around the exterior perimeter of assembly 10. Detail of adhesion of the low side panel over roof ribs 31 is shown in FIG. 11.

Figure 8:
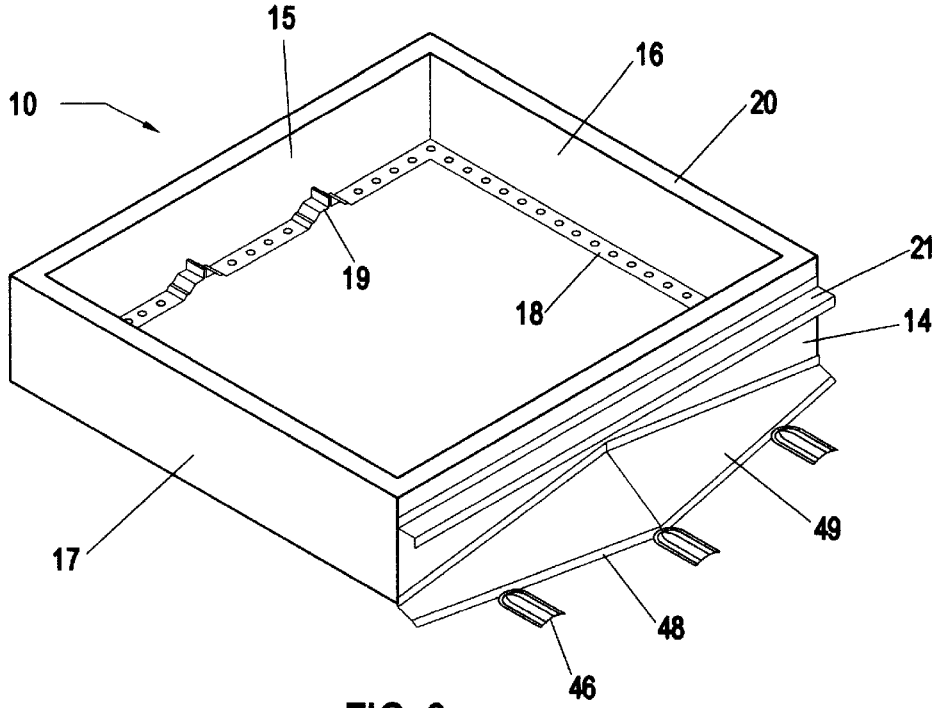
FIG. 8 is a perspective view of the roof curb system of the present invention.
Figure 9:
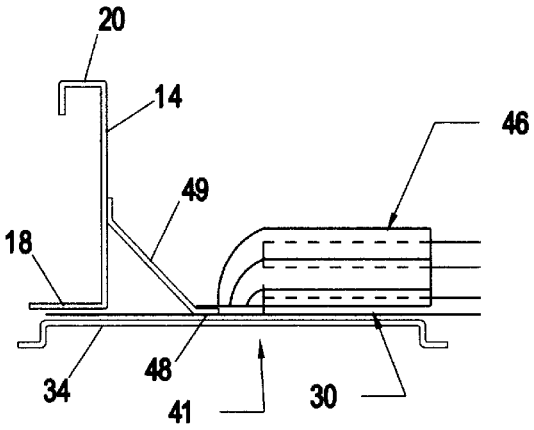
FIG. 9 is a cut away side view showing installation of the roof curb, cricket and bull nose.

One side of water diverting cricket 49 is then attached to the outside of high side panel 14 as shown in FIGS. 1, 8 and 9. The opposite side is attached to roof panels 30 and over flattened flanges 54. Double sided adhesive material is provided along the edges of cricket 49 which are attached to both panel 14, as well as along edges 48 which are attached to roof 30 and flanges 54. Bull noses 46 are then attached to cover over: the cuts 41 in ribs 31, the flattened flanges 54, and the lower edges 48 of cricket 49 as shown in FIG. 9. Double sided waterproof material is provided along the entire perimeter of the bull noses to seal over the cuts 41 and flanges 54. This provides an aesthetically appealing appearance on the high side of the installed roof curb assembly.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. An improved curb system for attachment to a roof having standing seams between adjacent roof panels comprising an open upper frame having an interior, an exterior and a plurality of sides, each side having a lower interior peripheral flange for attachment to an upper surface of said roof panels, and an upper interior peripheral flange for supporting equipment; a water-diverting flange attached to the exterior of one of said upper frame sides; and a plurality of recesses along the roof attachment flange of the upper frame side opposite from said water diverting flange wherein a second support frame is provided for attachment to the underside of said roof panels corresponding to the position of said upper frame.

2. The roof curb system of claim 1 wherein a water diverting cricket is provided for attachment to the exterior of the upper frame side supporting the water-diverting flange, below said flange, and to the upper surface of the adjacent roof panels.

3. The roof curb system of claim 2 wherein the seams between adjacent roof panels are cut and flattened in the area immediately adjacent to the upper frame side supporting said exterior flange and cricket.

4. The roof curb system of claim 3 wherein covers are provided for placement over the open ends of the roof seams exposed by said cuts.

5. The roof curb system of claim 4 wherein said first and second frame have a generally rectangular shape.

6. The roof curb system of claim 5 wherein plugs are provided for insertion into the open ends of the roof seams under said covers.

7. The roof curb system of claim 6 wherein waterproof material is provided between said lower flanges and said roof panels, between said cricket and said roof panels, and between said covers and said roof panels and seams.

8. A method of installing a curb assembly on a roof having longitudinal standing seams between adjacent roof panels comprising the steps of:

a. cutting a generally rectangular opening into said roof panels;

b. installing a generally rectangular support frame below said opening;

c. making perpendicular cuts on the roof seams on the high side of said opening;

d. flattening the cut areas of said roof seams;

e. installing a curb assembly above said opening corresponding to said support frame, said curb assembly comprising a generally rectangular open upper frame having an interior, an exterior and a plurality of sides, each side having a lower interior peripheral flange for attachment to an upper surface of said roof panels, and an upper interior peripheral flange for supporting equipment, one side of said upper frame having a water-diverting flange attached to the exterior thereof, the opposite side of said upper frame having a plurality of recesses along the roof attachment flange thereof for receiving said roof seams; and f. installing waterproof material between said lower flanges and the upper surfaces and seams of said roof panels.

9. The method of claim 8 including the additional step of attaching a water-diverting cricket to the exterior of the high side of the upper frame and to the upper surface of the adjacent roof panels.

10. The method of claim 9 including the additional step of inserting plugs into the open ends of said cut roof seams.

11. The method of claim 10 including the additional step of installing covers over the open ends of said cut roof seams.

* * * * *